US005379557A

United States Patent [19]

Kotter

[11] Patent Number: 5,379,557

[45] Date of Patent: Jan. 10, 1995

[54] ARCHITECTUAL PANEL SYSTEM FOR GEODESIC-LIKE STRUCTURES

[75] Inventor: Rodman W. Kotter, 10815 Molony Rd., Culver City, Calif. 90230

[73] Assignee: Rodman W. Kotter, Culver City, Calif.

[21] Appl. No.: 135,138

[22] Filed: Oct. 8, 1993

Related U.S. Application Data

[60] Continuation of Ser. No. 817,155, Jan. 6, 1992, abandoned, which is a continuation-in-part of Ser. No. 586,793, Sep. 24, 1990, Pat. No. 5,077,949, which is a continuation-in-part of Ser. No. 355,788, May 19, 1989, Pat. No. 4,958,476, which is a division of Ser. No. 174,516, Mar. 28, 1988, abandoned.

[51] Int. Cl.[6] ..... E04B 1/32; E04H 12/06

[52] U.S. Cl. ..... 52/81.1; 52/591.2

[58] Field of Search ..... 52/81.1, 81.4, 81.5, 52/506.01, 506.09, 506.1, 590, 588

[56] References Cited

U.S. PATENT DOCUMENTS

| | | | |
|---|---|---|---|
| 304,792 | 9/1884 | Butz . | |
| 881,522 | 3/1908 | Winslow | 52/630 |
| 943,306 | 12/1909 | Harry | 138/156 |
| 1,049,543 | 1/1913 | Smith | 138/156 |
| 1,158,307 | 10/1915 | Schmidt | 403/340 |
| 1,231,348 | 6/1917 | Hernandez | 52/577 |
| 1,247,511 | 11/1917 | Dickelman | 52/82 |
| 1,585,266 | 5/1926 | Schlafly | 285/330 |
| 1,605,513 | 11/1926 | Connery | 52/630 |
| 1,989,834 | 2/1935 | Watson | 52/729 |
| 2,102,936 | 12/1937 | Bailey | 428/182 |
| 2,164,966 | 7/1939 | Tutein | 493/295 |
| 2,733,784 | 2/1956 | Berry | 52/81 |
| 2,792,164 | 4/1957 | Cauffiel . | |
| 3,099,900 | 8/1963 | Beck | 29/453 |
| 3,186,524 | 6/1965 | Spaeth, Jr. . | |
| 3,254,459 | 6/1966 | Bodley | 52/81 |
| 3,346,998 | 10/1967 | Nelson | 52/70 |
| 3,444,558 | 5/1969 | Leitner | 52/630 |
| 3,477,894 | 11/1969 | Graff et al. | 156/459 |
| 3,524,288 | 8/1970 | Coppa | 52/81 |
| 3,538,664 | 11/1970 | Frandsen et al. | 52/311 |
| 3,557,501 | 1/1971 | Kolozsvary | 52/81 |
| 3,638,434 | 2/1972 | Delaere | 52/245 |
| 3,810,336 | 5/1974 | Sadao | 52/81 |
| 3,893,277 | 7/1975 | Constant | 52/630 |
| 3,967,023 | 6/1976 | Lysek | 428/102 |
| 4,115,963 | 9/1978 | Lubov | 52/81 |
| 4,308,698 | 1/1983 | Fleishman | 52/81 |
| 4,375,491 | 3/1983 | Honig | 428/167 |
| 4,401,705 | 8/1983 | Ewert | 52/309.1 |
| 4,414,257 | 11/1983 | Haraga et al. | 52/801 |
| 4,665,665 | 5/1987 | Wilkinson | 52/82 |
| 4,776,139 | 10/1988 | Lockwood | 52/82 |
| 4,836,787 | 6/1989 | Boo | 446/114 |
| 4,953,329 | 9/1990 | Frantl | 52/81 |
| 4,958,476 | 9/1990 | Kotter | 52/745 |
| 5,077,949 | 1/1992 | Kotter | 52/630 |

FOREIGN PATENT DOCUMENTS

| | | | |
|---|---|---|---|
| 522270 | 3/1956 | Canada | 52/107 |
| 606670 | 6/1926 | France . | |
| 1280028 | 5/1962 | France . | |
| 1340142 | 9/1963 | France . | |
| 360935 | 7/1938 | Italy . | |
| 384191 | 12/1922 | United Kingdom | 446/111 |
| 509434 | 7/1939 | United Kingdom . | |

*Primary Examiner*—James L. Ridgill, Jr.
*Attorney, Agent, or Firm*—Pretty, Schroeder, Brueggemann & Clark

[57] ABSTRACT

An architectural panel system for assembling geodesic-like structures in which three or more corrugated panels of relatively thin material are joined along their sides to form a polyhedral angle. The corrugations may be formed in the panel surface or along side flanges provided for attaching adjoining panels together, or both. Corrugations in the side flanges serve to interlock adjoining panels together directly or through use of interlocking channel members. Surface corrugations in triangular and pentagonal panels for spherical domes are formed perpendicular to the edges of the panels and converge along load distribution grooves formed in the panel surfaces from the corners of the panels to their centers. Corrugations in the panel surface and along the side flanges are intercorrugated relative to one another for more strength and stiffness. The panels are preferably formed using polycarbonate plastic material.

19 Claims, 6 Drawing Sheets

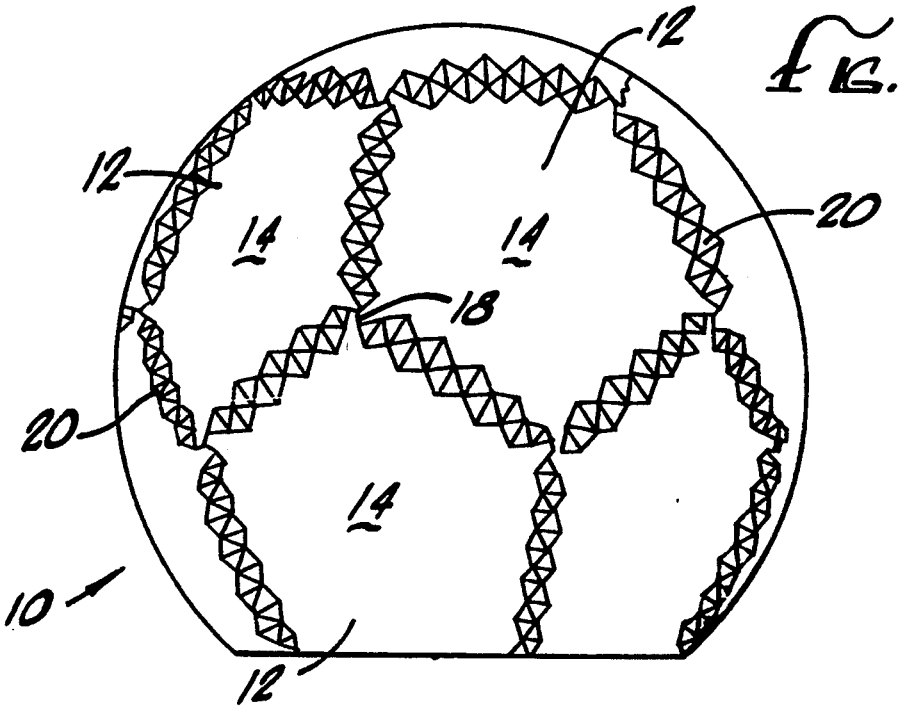
FIG. 1a.
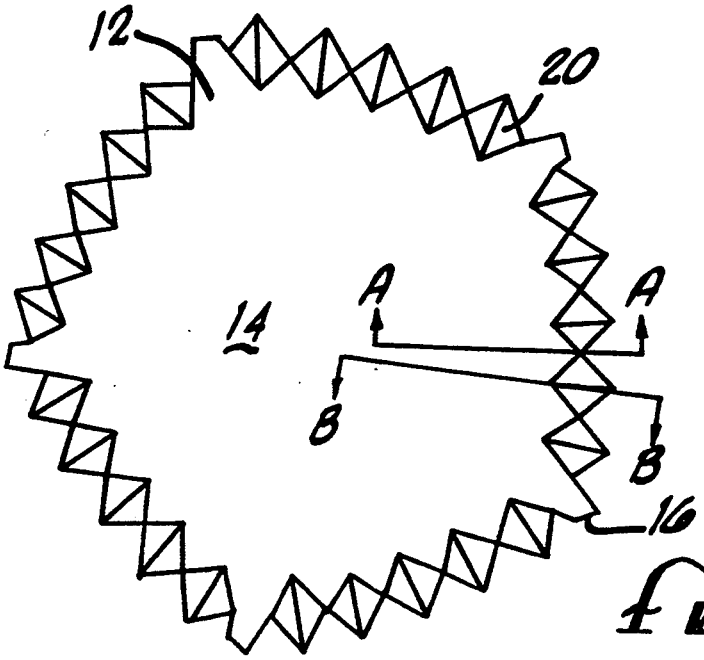
FIG. 1b.
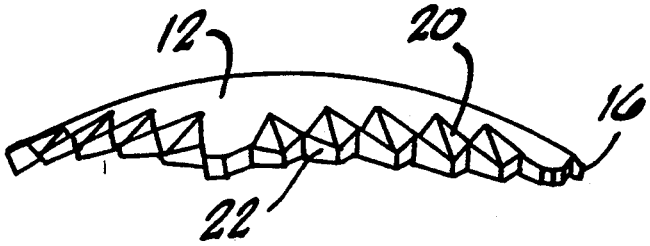
FIG. 1c.
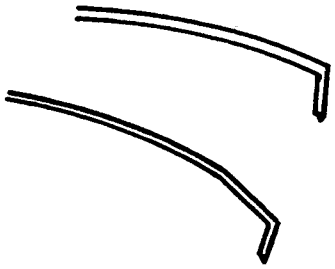
FIG. 1d.
FIG. 1e.

ARCHITECTUAL PANEL SYSTEM FOR GEODESIC-LIKE STRUCTURES

This is a continuation of application Ser. No. 07/817,155, filed Jan. 6, 1992, now abandoned which is a continuation in part of application Ser. No. 07/586,793, filed Sep. 24, 1990, now U.S. Pat. No. 5,077,949 which is a continuation in part of application Ser. No. 07/355,788, filed May 19, 1989, now U.S. Pat. No. 4,958,476, which is a divisional of Ser. No. 07/174,516, filed Mar. 28, 1988, abandoned.

The present invention concerns architectural structures, and more particularly, relates to an architectural panel system for forming covers or shelters in the nature of geodesic-like structures. Such structures are used for various purposes, including radomes, storage facilities, housing and public buildings.

Geodesic-like structures are well known. An example of one is described in U.S. Pat. No. 2,682,235 to R. Buckminister Fuller. It has long been desired in building such structures and frames to obtain maximum strength and space with a minimum of materials. It has been a further goal to simplify the structures as much as possible for easier and less costly construction.

The object of the present invention is to provide an architectural panel system for constructing geodesic-like structures of various shapes and sizes that achieve a higher strength with a simpler and less costly construction than heretofore known.

SUMMARY OF THE INVENTION

Briefly, and in general terms, the present invention provides an architectural panel system that is ideally suited to the assembly of geodesic-like structures with corrugated panels of relatively thin material that are inexpensive, lightweight and easy to assemble in a variety of shapes and sizes for diverse uses, yet exhibit a high resistance to pressure-loading forces such as caused by wind or snow.

More specifically, the present invention resides in an architectural panel system in which three or more corrugated panels are joined along their sides to form a polyhedral angle. This basic structure can serve as a cover itself, or it can be used as a unit for a larger geodesic-like structure made up of any number of similar units formed of panels joined together in like manner along their edges to each other and to other units.

Numerous different spherical and non-spherical geodesic-like structures can be assembled from appropriately shaped panels with this architectural panel system. The shapes of the corrugated panels may be triangular, rectangular, pentagonal or other regular or irregular polygonal configurations. The panel surfaces themselves may be flat or curvilinear.

The corrugations on individual panels may be formed in the panel surface or along side flanges provided for attaching adjoining panels together, or both. Surface corrugations may extend only partially or substantially all the way across the panel surface, depending on the requirements of the particular structure, to increase the surface stiffness of the panel and its resistance to pressure loading. Complementary corrugations formed in the side flanges of adjoining panels may nest and serve to interlock the panels together with appropriate fastening means to provide added strength and ease of assembly.

Corrugations in the panel surface may be formed in any number of useful patterns. For example, in a presently preferred embodiment, the corrugations in the surfaces of triangular and pentagonal panels for a spherical geodesic-like dome are formed substantially perpendicular to the edges of the panels to enable the side corrugations to be formed uniformly. Because the edges of these panels follow a geodesic line along an equator of the spherical dome, the corrugations follow paths which converge as longitudinal lines to the pole normal to that equitorial plane, such that the corrugations themselves converge on the panel along lines which in effect divide the panel surface into as many segments as it has sides. To eliminate unfavorable stress concentrations where the surface corrugations converge and distribute stresses, grooves can be formed in the panel surfaces along those lines of convergence from the corners of the panel to its center. Surface corrugations in parallelogram-shaped panels, on the other hand, can be formed diagonally across the face of the panel without creating undesirable non-uniformities in the side corrugations. In addition, corrugations in the panel surface and along the side flanges advantageously may be intercorrugated relative to one another for more strength and stiffness.

The side flanges of the architectural panels may be fastened together directly with rivets, screws, adhesive bonding or in any other suitable manner, or by use of separate interlocking members for greater mechanical integrity and weatherproofing. For example, the interlocking members may take the form of channels into which the nested corrugations of adjoining side flanges are received and fastened. A multi-legged channel may be provided to fasten and reinforce the corner junctions of the side flanges of the panels at the vertex of the polyhedral angle, with a separate channel radiating from a centerpoint to receive each pair of adjoined side flanges. A single-legged channel may be provided to fasten and reinforce each pair of side flanges along substantially their entire length between vertices. In a further refinement, the single-legged channels may be joined at one or both ends to the multi-legged channels at the vertices of the polyhedral angles for yet greater mechanical integrity. The channels can serve to seal the junctions between adjoining panels and possibly carry off any water that penetrates the junctions.

The corrugated construction and strong, interlocking junctions of the panels enable use of very thin-wall panels, which are preferably formed using polycarbonate plastic material. The resulting geodesic-like structures are inexpensive, lightweight, easy to construct, weatherproof, and exhibit high strength against pressure loading forces, and are ideal as radomes, covers for storage tanks, and a wide variety of shelters.

The novel features which are believed to be characteristic of the present invention, together with further objectives and advantages thereof, will be better understood from the following detailed description considered in connection with the accompanying drawings, wherein like numbers designate like elements. It should be expressly understood, however, that the drawings are for purposes of illustration and description only and are not intended as a definition of the limits of the invention.

DESCRIPTION OF THE DRAWINGS

The accompanying drawings illustrate, by way of example, presently preferred embodiments of the invention, in which:

FIG. 1*a* is a side elevation of one embodiment of a geodesic-like structure formed by corrugated architectural panels having a pentagonal shape in accordance with the present invention;

FIG. 1*b* is a plan view of one panel from the structure in FIG. 1*a;*

FIG. 1*c* is a side view of the panel in FIG. 1*b;*

FIG. 1*d* is a partial cross-sectional view of the panel taken along the line A—A in FIG. 1*b;*

FIG. 1*e* is a partial cross-sectional view of the panel taken along the line B—B in FIG. 1*b;*

DETAILED DESCRIPTION OF THE PREFERRED EMBODIMENTS

Figure 2:
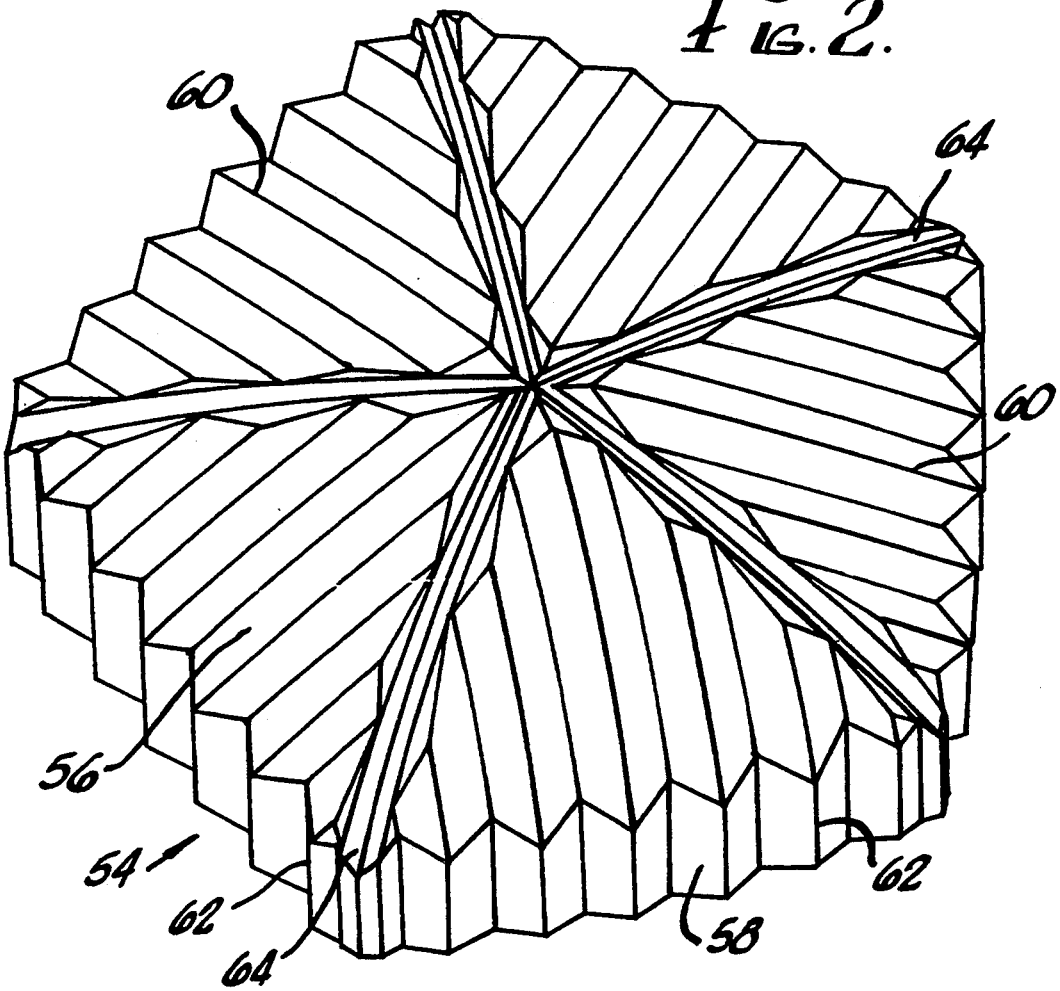
FIG. 2 is a perspective view of another embodiment of a corrugated pentagonal panel suitable for use in the geodesic-like structure in FIG. 1*a;*

Referring now to the drawings, and particularly FIGS. 1*a*–1*e* thereof, there is shown an illustrative truncated spherical antenna cover or radome 10 formed by the joinder of eleven identical architectural panels 12, giving the structure a dodecahedral form, in which the bottom five panels have been trimmed for mounting to a foundation (not shown). The surface 14 of each panel 12 has a generally pentagonal shape and is bounded along its edges by side flanges 16 that are formed perpendicular to the panel surface. The intersection of any three panels 12 in a vertex 18 may be considered to form a polyhedral angle, although in this particular embodiment the panels have a generally curvilinear rather than a flat surface. The radius of curvature of the panels 12 is the same as that of the dome 10. The curvilinear shape of the panels 12 helps to stiffen their surfaces.

The surfaces 14 of the panels 12 have corrugations 20 to increase the strength and stiffness of the panels. In FIGS. 1*a*–1*c*, the surface corrugations 20 extend only a small way into the panel surfaces 14 from their edges, leaving the remainder of the panel surfaces smooth. The side flanges 16 also have corrugations 22 to facilitate manual assembly of the panels 12 and add strength to the cover 10. As seen in FIG. 1*a*, the corrugations 22 in each side flange 16 nest with the corrugations in an adjoining side flange to form strong, interlocking junctions. The panels 12 use the innovative intercorrugation structure disclosed in co-pending application Ser. No. 07/586,793, which is incorporated herein by reference as though set forth in full. That is, corrugations 20 in the panel surface 14 are intercorrugated with the corrugations 22 of the side flanges 16. (See FIGS. 1*d* and 1*e*.) These intercorrugations add to the mechanical strength and function of the cover 10. The panels can be made of any suitable material, including metal, although for most applications it is presently preferred to make them of a polycarbonate plastic material by vacuum forming techniques.

A structure such as cover 10 is assembled by simply mating the side flanges 16 of adjoining panels 12 and fastening them together by any suitable means, such as rivets, screws or adhesive bonding. Alternatively, T-shaped interlocking channel members in both multi-legged and single-legged configurations 24 and 26 shown in FIGS. 3*a* and 3*b*, respectively, are provided into which the mated side flanges 16 may be received and fastened.

The multi-legged channel member 24 is formed as a trefoil in which each of three channels 28, 30 and 32 radiate from a common center point at the same angles and with the same curvature as the intersecting panels 12 which form the polyhedral angle. Of course, it will be appreciated that in the case of structures employing more than three panels to form a polyhedral angle, additional legs in the appropriate configuration can be added as needed. The free end of each channel 28, 30 and 32 has holes 34 formed laterally through its sidewalls 36 to receive a rivet or screw to hold the mated side flanges 16 near the vertex 18 and reinforce the corner junction of the panels 12. The bottom walls 38 of the channels 28, 30 and 32 extend laterally beyond the sidewalls 36 for added strength.

Figure 3B:
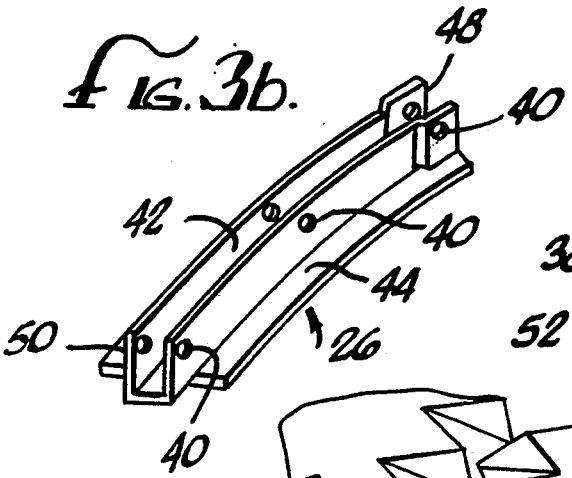
FIG. 3*b* is a perspective view of one embodiment of a single-legged interlocking channel member.
Figure 3A:
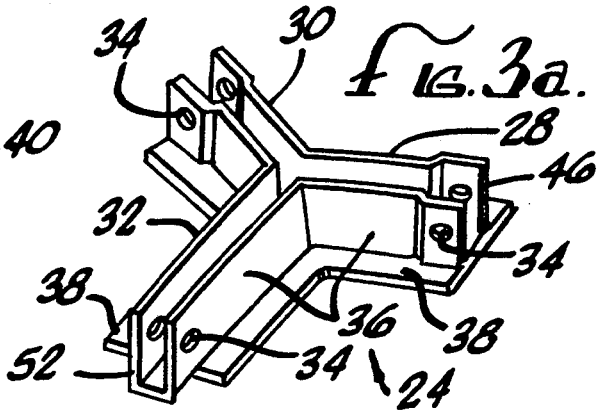
FIG. 3*a* is a perspective view of one embodiment of a multi-legged, trefoil interlocking channel member in accordance with the invention.

The single-legged channel member 26 is a simple, elongated channel with holes 40 through its sidewall 42 for rivets or screws spaced along its length and a bottom wall 44 that likewise extends laterally for added strength. It may be used to secure the mated side flanges 16 of adjoining panels 12 together between vertices 18. As shown in FIG. 3*b*, the single-legged channel member 26 similarly is curved to complement the curvature of the adjoining side flanges 16.

Alternating ends 46 and 48 of the multi-legged and single-legged channel members 24 and 26, respectively, are flared to receive unflared ends 50 and 52 of adjacent channel members. In this way, all of the channel members in the cover 10 may be joined together by the same rivets or screws holding mated side flanges 16 in place. These channel members 24 and 26, when joined to the side flanges 16 and to each other, form a stiff, monocogue structure.

In addition to joining the side flanges 16 together, the interlocking channel members 24 and 26 serve to weatherproof junctions between adjoining panels 12. In this regard, it can be noted that the bottom edges of the mated side flanges 16 can abut the bottom walls 38 and 44 of the channels 24 and 26, respectively, or alternatively the channels can be formed sufficiently deep that adequate free space remains between the bottom edges of the side flanges and the bottom walls of the channels to serve as ducts to carry off any water that penetrates the junctions between adjoining panels 12. As with the panels themselves, the channel members 24 and 26 can be formed of any suitable material including metal or plastic.

Turning to FIG. 2, there is shown another possible form of a pentagonal architectural panel 54 having a curvilinear surface that is suitable for the geodesic-like dome 10 of FIG. 1*a*, in which substantially the entire surface 56 and the side flanges 58 of the panel are corrugated. The surface corrugations 60 are formed substantially perpendicular to the edges of the panel 54. This enables the side corrugations 62 to be formed in a uniform size and pattern along the side flanges 58.

By referring back to FIG. 1*a*, it will be appreciated that each of the edges of these panels 54 follows a geodesic line along an equator of the dome 10. Therefore, the surface corrugations 60 follow paths which converge as longitudinal lines to the pole that corresponds to that equitorial plane. Hence, the corrugations 60 themselves converge on the panel 54 along lines which extend from the corners of the panels to their centers. It has been determined that if the surface corrugations 60 were permitted to meet, unfavorable stress concentrations and possible buckling of the panel 54 could occur under load of pressure forces from wind or snow or the like. To alleviate this potential problem, load distribution grooves 64 are formed in the panel surface 56 along these lines of convergence as a stiffening junction between the converging surface corrugations 60.

Figure 3C:
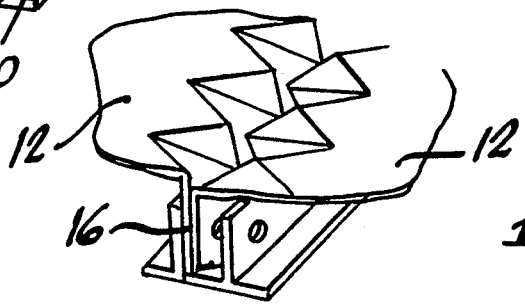
FIG. 3*c* is a partial perspective view of two nested corrugated side flanges of adjoining panels mounted in a portion of an interlocking channel member.
Figure 4:
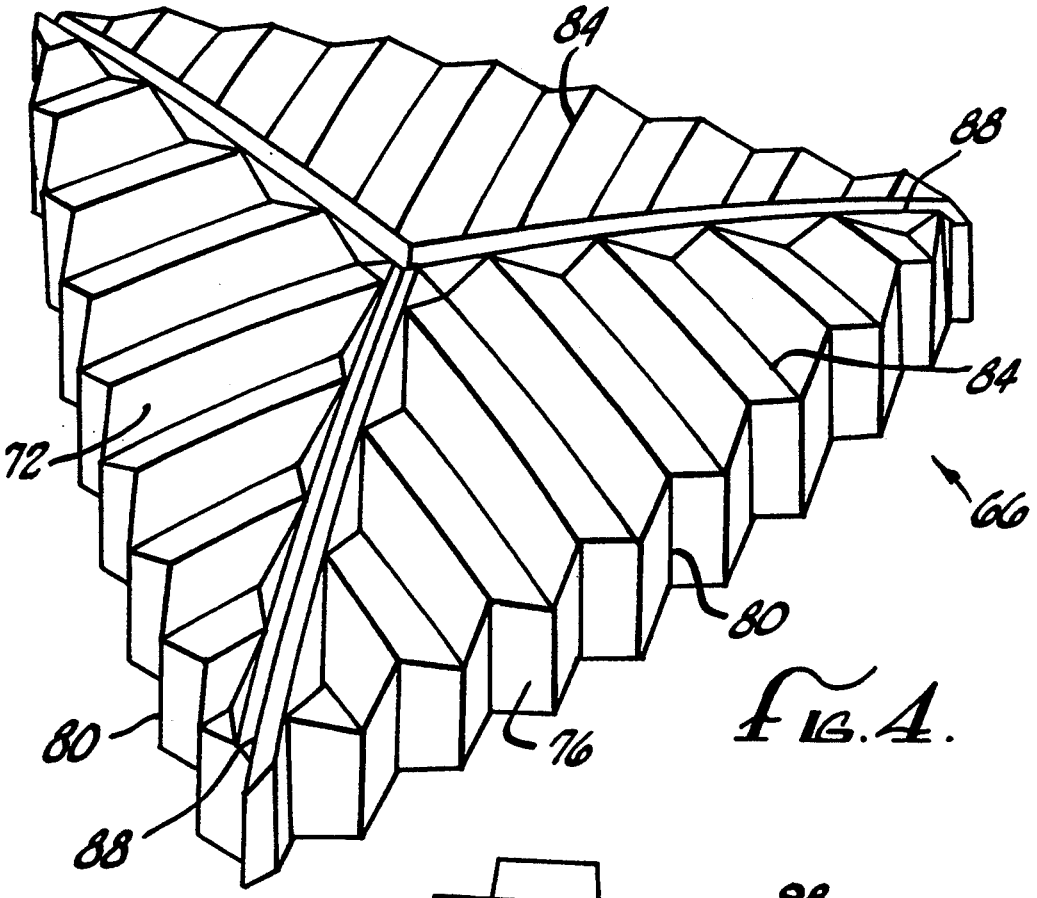
FIG. 4 is a perspective view of another embodiment of an architectural panel having a triangular shape suitable for assembly into a geodesic-like structure.
Figure 6B:
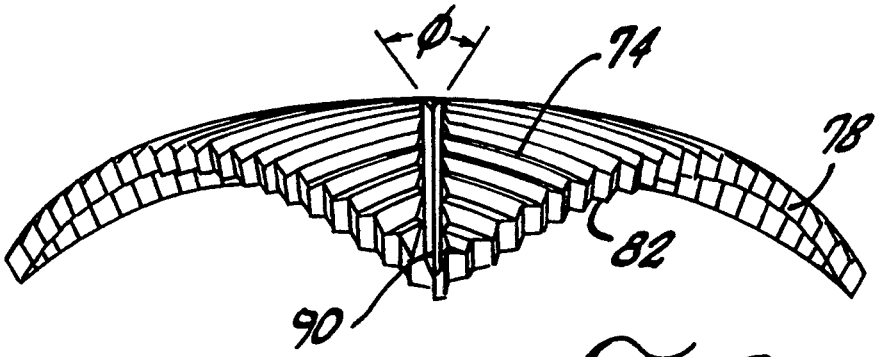
FIG. 6*b* is a front elevational view of the panel in FIG. 6*a;*
Figure 6A:
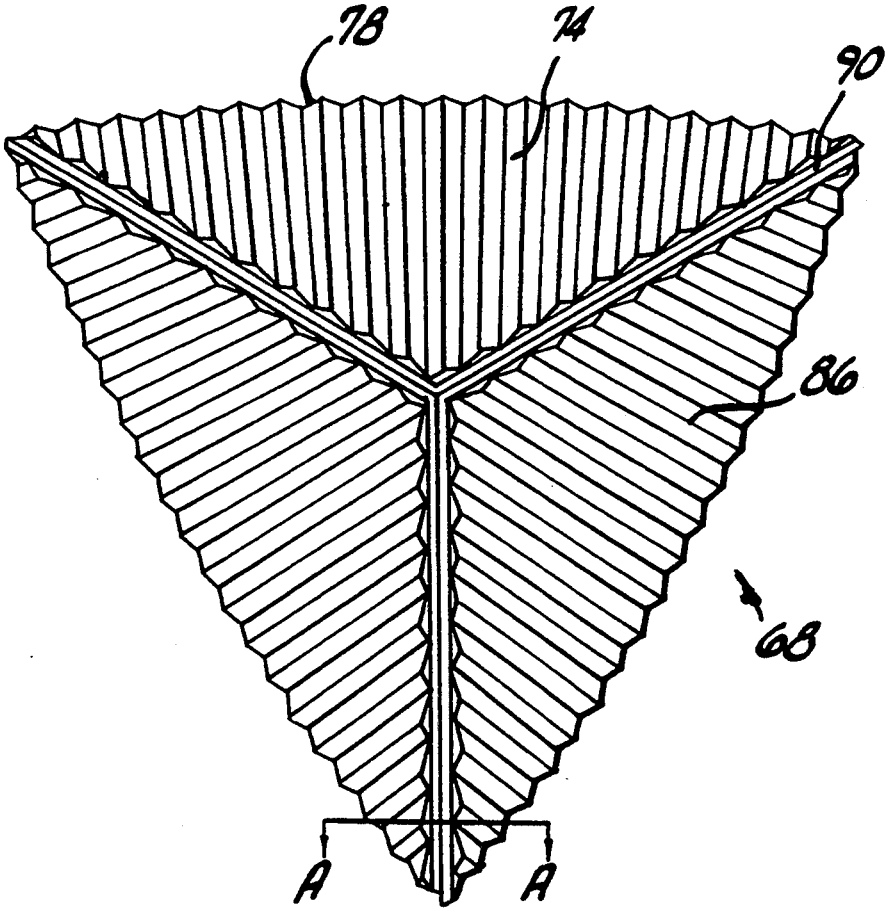
FIG. 6*a* is a plan view of a triangularly-shaped corrugated panel similar to the panel of FIG. 4 suitable for assembly into a geodesic-like structure.
Figure 6D:
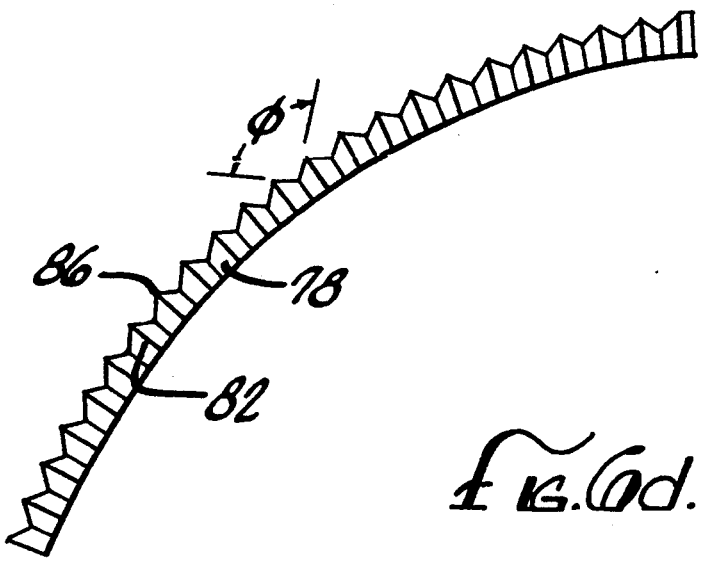
FIG. 6*d* shows the edge detail of the panel in FIGS. 6*a*–6*c;*
Figure 6C:
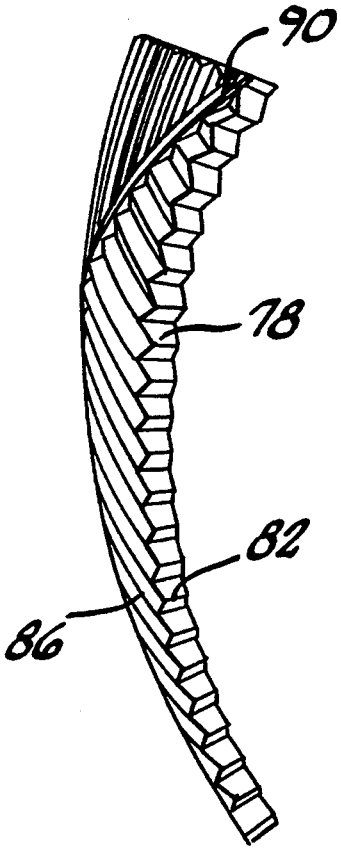
FIG. 6*c* is a side elevational view of the panel in FIG. 6*a;*
Figure 6E:
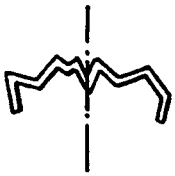
FIG. 6*e* is a partial cross-sectional view of the panel taken along the line A—A in FIG. 6*a;*
Figure 7A:
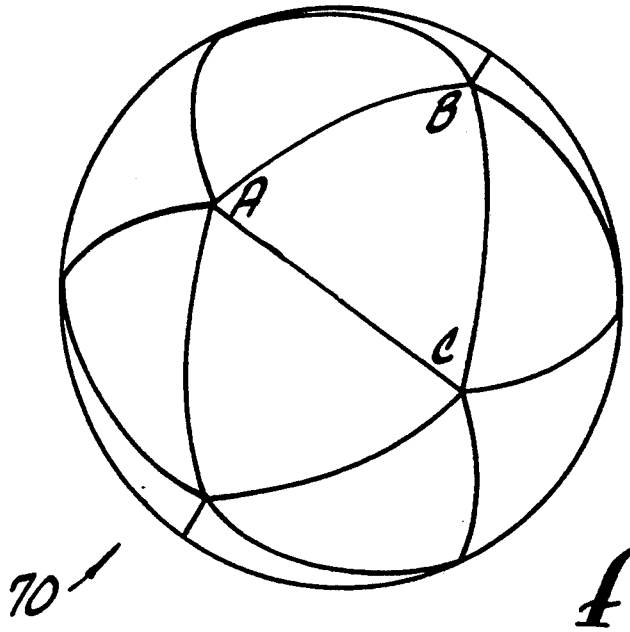
FIG. 7*a* is an illustration of an icosahedral geodesic-like dome formed by an assembly of twenty equilateral triangular panels.

FIGS. 4 and 6*a*–6*e* show equilateral triangular-shaped panels 66 and 68, respectively, which may be used to form an icosahedral geodesic dome 70, as illustrated in FIG. 7*a*. The geodesic dome 70 of FIG. 7*a* has a spherical shape formed by joining twenty such triangularly-shaped panels. The panels 66 and 68 have corrugations both in their surfaces 72 and 74, as well as in their side flanges 76 and 78, respectively. The corrugations 80 and 82 in the side flanges 76 and 78, respectively, are intercorrugated with the corrugations 84 and 86 formed in the panel surfaces 72 and 74, respectively, and nest with corrugations in side flanges of adjacent panels. As with the pentagonally-shaped panel 12 of FIGS. 1*a*–1*e*, the side flanges 76 and 78 of these triangular panels 66 and 68 can be fastened directly together or through use of interlocking channel members similar to those shown in FIGS. 3*a*–3*c*.

Like the pentagonally-shaped panels of FIGS. 1*a*–1*3* and 2, the edges of the triangular panels 66 and 68 shown in FIGS. 4 and 6*a*–6*e* follow geodesic lines. See FIG. 7*a*. Likewise, the surface corrugations 84 and 86 are formed perpendicular to the edges of the panels 66 and 68 such that they follow longitudinal paths and converge along lines extending from the corners of the panels to their centers. Load distribution grooves 88 and 90, respectively, shown in cross-section in FIG. 6*e*, are formed along these convergence lines to avoid stress concentrations and better distribute stresses in the panels under load.

In the case of antenna covers, very thin radome walls are essential to low loss, broad band, microwave transmission. An 80-inch radome with a peak-to-valley surface corrugation depth of 0.625 inches was designed with the panels of FIG. 6*a*–6*e* having a nominal material thickness of 0.020 inches made from LEXAN brand polycarbonate plastic by General Electric Company. By critical selection of an included angle ∅ of 60 degress for the load distribution groove 90 (FIG. 6*b*) and an included angle ∅ of 90 degrees for the surface corrugations 86 (FIG. 6*d*), analyses show that the panel should withstand a pressure equal to a wind of 150 mph without tackling with a safety factor of four to five.

For radome applications, it will be appreciated that it is desirable to utilize very thin panels and maintain all corrugations and load distribution grooves shallow to minimize insertion losses and avoid inhibiting radiation propagation. Although different design considerations may control in other applications, such as storage facilities, the architectural panel system of the present invention is still advantageous in permitting use of light, thin and inexpensive panels that are easy to assemble into the desired structure.

Figure 7B:
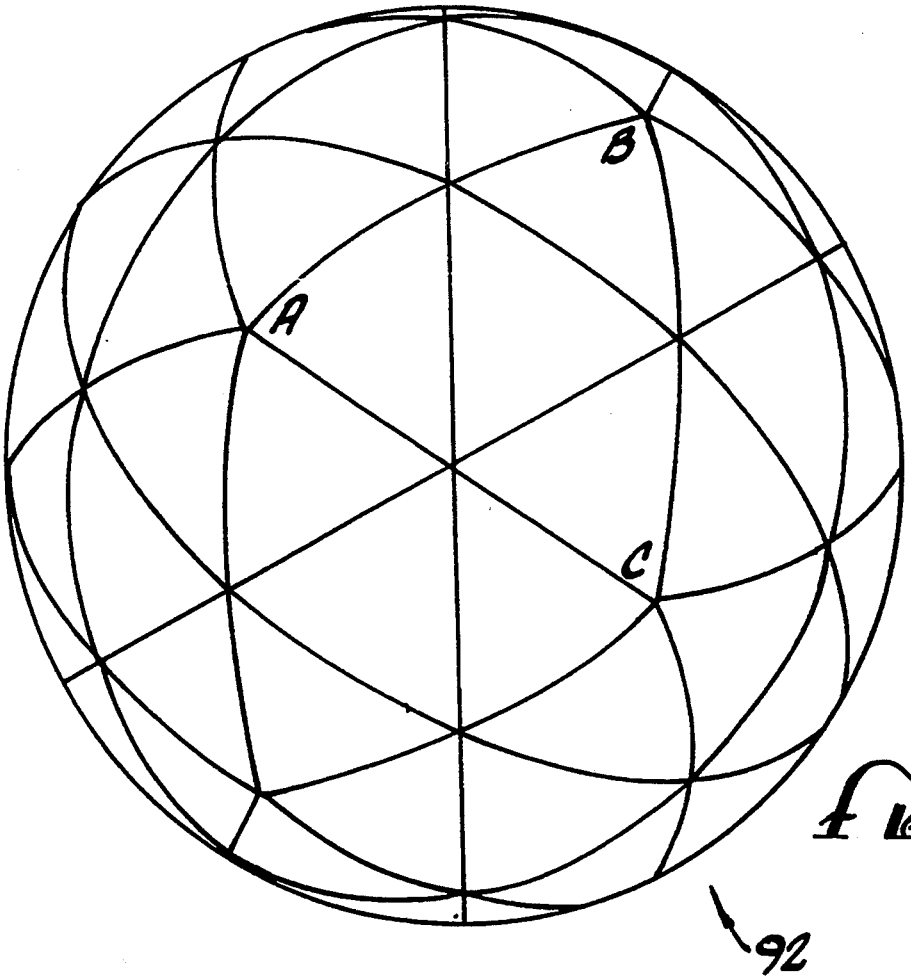
FIG. 7*b* is an illustration of a larger, eighty section polyhedral dome in which each icosahedral triangular section in FIG. 7*a* has been further divided into four triangular sections.

If the radius of a structure becomes very large, the equilateral triangular sections of an icosahedral type dome may be too large to handle conveniently, compared to smaller sections of an equally large polyhedral dome having, for example, eighty sections. As indicated in FIG. 7*b*, the eighty sectioned polyhedral dome 92 would be formed by dividing each icosahedral triangular section into four triangular sections. This would be done by connecting the mid points of each leg of a triangular icosahedral section (A, B, C) in FIG. 7*a* with a geodesic line. Thus, there are formed three identical isosceles triangular sections and one equilateral triangular section. Each new triangular section has approximately one fourth the area of the original icosahedral section and about the same area as the icosahedral section of a spherical dome with half the radius. This process of dividing panels of a polyhedral geodesic form is described in the works of R. Buckminister Fuller as increasing the frequency of a polyhedral form.

Repeating the process on panel sections of very large polyhedral domes, therefore, is a logical procedure to maintain convenient dimensions for its panel sections. Thus, geodesic dome, thin-wall panels, with manageable dimensions can be designed regardless of the overall dome dimensions. Moreover, the general corrugation pattern in triangular panel sections used in the higher frequency polyhedral domes will follow the geometric and structural principles illustrated by the panels shown in FIGS. 4 and 6*a*–6*d*.

Figure 5:
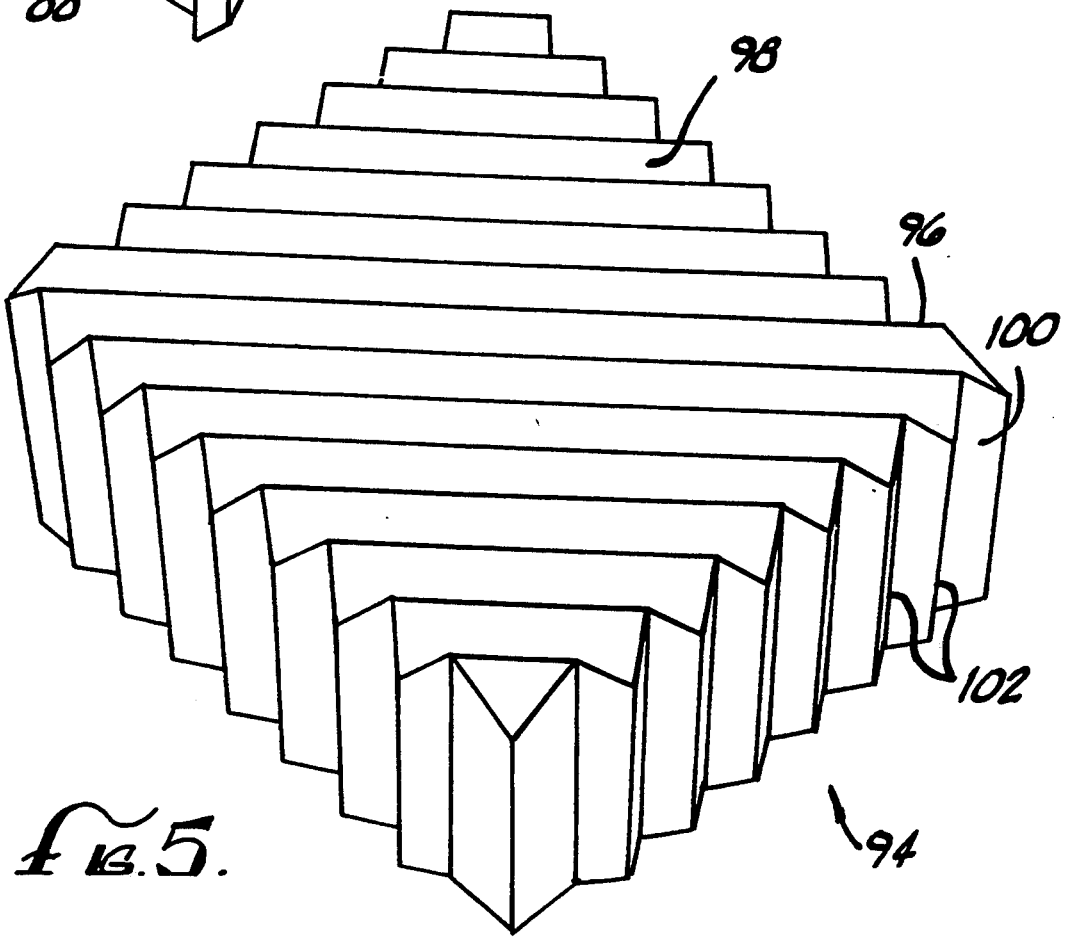
FIG. 5 is a perspective view of yet another embodiment of a corrugated panel having a rectangular shape suitable for assembly into a geodesic-like structure.

FIG. 5 shows a parallelogram type of panel 94 that is rectangular in shape with corrugations 96 in the panel surface 98 and side flanges 100 with corrugations 102 for interlocking adjacent panels. Unlike the triangular and pentagonal panel shapes, however, the surface corrugations 96 on this rectangularly-shaped panel 94 can be formed diagonally relative to the edges of the panel without creating distortions or non-uniformities in the corrugations 102 of the side flanges 100. Panel 94 has the advantage of being easier and less expensive to manufacture by virtue of its uninterrupted diagonal surface corrugations.

It will be understood, of course, that modifications of the present invention will be apparent to others skilled in the art. Consequently, the scope of the present invention should not be limited by the particular embodiments described above, but should be defined only by the claims set forth below and equivalents thereof.

I claim:

1. An architectural panel system comprising at least three panels, each of said panels having a panel surface bounded along at least two edges thereof by side flanges formed integrally with said panels, each of said side flanges having a flange surface extending away from said panel surface substantially perpendicularly thereto, and means for fastening each of said side flanges to the side flange of at least one other panel such that said at least three panels converge in a vertex to form a polyhedral angle, each of said flange surfaces having corrugations formed therein directed substantially perpendicular to the edge of the panel surface that engage complementary corrugations formed in a flange surface of an adjoining panel.

2. An architectural panel system as defined in claim 1, wherein each of said panel surfaces has corrugations formed therein over at least portion of the panel surface.

3. An architectural panel system as defined in claim 2, wherein each of said panel surfaces has corrugations formed therein over substantially all of the panel surface.

4. An architectural panel system as defined in claim 2, wherein the corrugations in each of said panel surfaces are intercorrugated with the corrugations formed in said flange surfaces.

5. An architectural panel system as defined in claim 2, wherein each of said panels has a polygonal configuration.

6. An architectural panel system as defined in claim 2, wherein each of said panels has a curvilinear panel surface.

7. An architectural panel system as defined in claim 2, wherein said panels form at least a portion of a substantially spherical geodesic-like dome.

8. An architectural panel system comprising at least three panels having corrugations formed in the surface thereof, said corrugations directed substantially perpendicularly to the edges of the panel surfaces, and each of the panels bounded along at least two edges by side flanges formed integrally therewith, each of the side flanges having surfaces extending away from said panel surface substantially perpendicular thereto, and means for fastening each of the side flanges to a side flange of at least one other panel such that said at least three panels converge in a vertex to form a polyhedral angle, and each of the flange surfaces having corrugations formed therein directed substantially perpendicular to the edge of the panel surface that interlock with complementary corrugations formed in a flange surface of an adjoining panel.

9. An architectural panel system as defined in claim 8, wherein the panel surfaces have a substantially polygonal shape.

10. An architectural panel system as defined in claim 9, wherein the panel surfaces have a substantially triangular shape.

11. An architectural panel system as defined in claim 9, wherein the panel surfaces have a substantially pentagonal shape.

12. An architectural panel system as defined in claim 9, wherein the corrugations in each panel surface converge along lines from the corners of the panel to its center.

13. An architectural panel system as defined in claim 12, wherein the panel surfaces are divided into as many segments as the panel has sides by grooves formed in each panel surface along the lines of convergence of the corrugations from the corners of the panel to its center, and further wherein the corrugations terminate substantially at the grooves.

14. An architectural panel system comprising at least three substantially parallelogram shaped panels having corrugations formed in the surface thereof, said corrugations directed diagonally to the edges of the panel surfaces, each of the panels bounded along at least two edges thereof by side flanges formed integrally with said panels, each of the side flanges having a surface extending away from said panel surface substantially perpendicularly thereto, and means for fastening each of the side flanges to a side flange of at least one other panel such that said panels form a polyhedral angle, and each of the flange surfaces having corrugations formed therein substantially perpendicular to the edge of the panel surface that interlock with corrugations formed in a flange surface of an adjoining panel.

15. An architectural panel system comprising:

at least three panels, each of said panels having a panel surface bounded along at least two edges by side flanges formed integrally therewith, each of said side flanges having a flange surface extending away from said panel surface substantially perpendicularly thereto, each of said flange surfaces having corrugations formed therein substantially perpendicular to the edges of the panel surface that nestingly mate with a flange surface of at least one adjoining panel such that said panels converge in a vertex to form a polyhedral angle; and means for fastening said mated flanges, said fastening means including an interlocking member for joining said panels together at the vertex of the polyhedral angle formed by the panels, said interlocking member having a leg for interlocking each adjoining pair of flange surfaces.

16. An architectural panel system as defined in claim 15, wherein the interlocking member comprises a plurality of channels radiating from a centerpoint in which adjoining side flanges are held together at the vertex.

17. An architectural panel system as defined in claim 15, wherein each pair of adjoining flange surfaces is further held together along substantially its entire length by an interlocking member.

18. An architectural panel system as defined in claim 17, wherein adjacent interlocking members are joined together.

19. An architectural panel system as defined in claim 17, wherein said interlocking members comprise channels in which adjoining flange surfaces are held.

* * * * *